US007779922B1

(12) United States Patent
Harris et al.

(10) Patent No.: US 7,779,922 B1
(45) Date of Patent: Aug. 24, 2010

(54) BREAKOUT DEVICE WITH SUPPORT STRUCTURE

(76) Inventors: John Allen Harris, 2044 E. Gallman Rd., Hazelhurst, MS (US) 39083; Johnny Mack Johnson, 1314 Hwy. 37, Taylorsville, MS (US) 39168; Craig Michael Randazzo, 3910 Hwy. 31, Leonville, LA (US) 70551

( * ) Notice: Subject to any disclaimer, the term of this patent is extended or adjusted under 35 U.S.C. 154(b) by 0 days.

(21) Appl. No.: 12/114,425

(22) Filed: May 2, 2008

Related U.S. Application Data

(60) Provisional application No. 60/927,733, filed on May 4, 2007.

(51) Int. Cl.
*E21B 19/16* (2006.01)

(52) U.S. Cl. ..... 166/379; 166/380; 285/376; 285/401; 285/402

(58) Field of Classification Search ..... 166/379, 166/380; 285/376, 401, 402
See application file for complete search history.

(56) References Cited

U.S. PATENT DOCUMENTS

| | | | | |
|---|---|---|---|---|
| 2,809,014 | A | 10/1957 | Lawrence | |
| 3,239,016 | A | 3/1966 | Alexander | |
| 3,768,579 | A | 10/1973 | Klein | |
| 4,691,790 | A | 9/1987 | Reichman | |
| 5,372,197 | A * | 12/1994 | Wacker | 166/311 |
| 5,544,712 | A | 8/1996 | McEwen | |

* cited by examiner

*Primary Examiner*—Giovanna C Wright

(57) ABSTRACT

A method and apparatus for supporting a tubular breakout device in a position. An embodiment of the device comprises a first channel in the inside face of the device for receiving a corresponding key of a quill, a socket adjacent to the first channel, and a second channel adjacent to the socket. An embodiment of the device is moved from the engaged position to the disengaged and supported position by the method of moving the device from an engaged position to a disengaged position, rotating the device so that the key of the quill slides into the socket of the device, then moving the device to a secured position by lowering the device so that the key of the quill slides into the second channel of the device.

6 Claims, 6 Drawing Sheets

BREAKOUT DEVICE WITH SUPPORT STRUCTURE

This application claims priority to U.S. provisional application No. 60/927,733 filed May 4, 2007 by Applicants, the entire content of which is hereby incorporated by reference.

FIELD

An embodiment of the device and method relates generally to the drilling industry. More particularly, an embodiment relates to a method and apparatus of a tubular breakout device having a support structure for maintaining the breakout device in a position, particularly a disengaged position.

BACKGROUND

In drilling, it is common practice to extend the length of the drill string by adding successive individual threaded sections of drill pipe to the top of the drill string. Each additional section of pipe is threaded to the preceding section. The rotation of the drill bit at the bottom of the drill string is accomplished by rotating the entire drill string. This rotation is induced by a drilling unit at the surface or top of the drill string, which rotates a quill. The quill is threaded to the last section of pipe in the drill string. This process continues until the drill string has reached the desired depth.

Once the drilling is completed and the pipe is to be removed from the drill string, the quill is operated in the reverse direction to unthread the individual pipe sections from the drill string. However, in the absence of external forces, it is unpredictable and difficult to control which of the threaded connections in the drill string will be broken first by this reverse rotation.

To avoid this problem, a drill unit is typically used which has a mechanism to move the quill along the machine at least the length of one section of the drill pipe. To unthread a section of drill pipe, the quill is first loosely threaded to the uppermost section of drill pipe. A breakout device, which coaxially surrounds the quill, is then manually lowered to simultaneously engage both the quill and the uppermost section of drill pipe in a manner which prevents the uppermost section of drill pipe and the quill from rotating in relation to each other. This is typically accomplished by providing a breakout device having one or more channels on its internal face which engage corresponding keys on both the quill and the drill pipe. In this manner, the threaded connection between the quill and the drill pipe is prevented from separating. The quill is then retracted so that the uppermost section of drill pipe is contained within the drill unit. The end of the next lower pipe is prevented from rotating. This may be accomplished by a slip and slip bowl assembly, wrench, tong wrench or any other method of locking the drill pipe in place. The quill is then rotated in the reverse or unthreading direction to break and completely separate the threaded connection between the two uppermost sections of drill pipe in the drill string. The single uppermost section of drill pipe is then swung away from the remainder of the drill string and the quill is lowered to allow a person to manually raise the breakout device from the engaged position to the disengaged position. The quill is then rotated in the reverse or unthreading direction, while a person holds the drill pipe in place, to separate the loosely threaded connection between the quill and the drill pipe. The quill is then loosely threaded to the next uppermost section of drill pipe in the drill string and the above process repeated until the entire drill string has been retracted.

The breakout device typically has two channels that run longitudinally along opposite sides of the inside face of the breakout device. These channels allow the breakout device to simultaneously engage keys located on opposite sides of both the quill and the drill pipe when the breakout device is in the engaged position. In the disengaged position, the breakout device is moved away from the drill pipe so that the breakout device is no longer engaged with the key of the drill pipe.

The breakout device is typically held in the raised or disengaged position by a chain connected to the quill on its upper end and the breakout device on its lower end. The lower end of the chain is connected to the breakout device in a manner which allows the chain and breakout device to be disconnected from each other. Typically this is achieved by attaching a hook to the breakout device which is suited to interlock with a link in the chain. To lower the breakout device from the disengaged to the engaged position, the chain is disconnected from the hook and the breakout device is lowered over the drill pipe so that the channels of the breakout device engage the key of the drill pipe.

The hook and chain assembly used to hold the breakout device in the disengaged position presents a significant safety hazard. When the drilling unit is in operation, the hook and chain rotate with the quill and breakout device regardless of whether the breakout device is in the engaged or disengaged position. While rotating, the hook and chain may contact the drilling unit operator, or any other person, causing injury to that person. There are other disadvantages of the hook and chain assembly that will be understood by those skilled in the art.

SUMMARY

An embodiment of the present device and method provides a device and method to support a breakout device in a position. In accordance with an embodiment, the breakout device has a cylindrical, hollow collar within which is formed a socket positioned adjacent to a channel, which is also formed within the collar. The socket is capable of receiving a key.

In another embodiment, the breakout device comprises a first channel in the inside face of the breakout device for receiving a corresponding key on a quill, a socket adjacent to the first channel, and a second channel parallel or substantially parallel to the first channel. The breakout device is moved from an engaged position to a disengaged and supported position by the method of moving the breakout device from an engaged position to a disengaged position, rotating the breakout device so that a key on a quill slides into the socket of the breakout device, then moved into a secured position by lowering the breakout device so that the key on the quill slides into a second channel of the breakout device. This allows the breakout device to be supported and locked in a disengaged position using the preexisting key of the quill. In an embodiment, the entire structure for supporting the breakout device in the disengaged position is contained within the breakout device itself. The second channel is considered to be substantially parallel to the first channel if a key on the quill is able to move from the first channel, through the socket, and into the second channel. The breakout device and other related parts may be constructed of any suitably strong material. The breakout device may be metal, such as steel, aluminum or aluminum alloys, a composite material, or any other suitable material. In an embodiment, the breakout device may be moved by any manual or powered means.

An embodiment of the breakout device may include a ring on the upper end of the breakout device. The ring provides a cap, barrier or end to the first channel of the breakout device.

This prevents the key on the quill from exiting the first channel of the breakout device when the breakout device is lowered into the engaged position. This ring may be semipermanently attached to the upper end of the breakout device by screws, bolts, clamps, or any other method of attachment. Maintenance, replacement or access to the keys on the quill may be accomplished by detaching the ring and lowering the breakout collar to expose the keys of the quill. The ring may be made of metal, such as steel, aluminum or aluminum alloys, a composite material, or any other suitable material.

An embodiment of the breakout device may also have contact points on the bottom end of the internal face of the breakout device that engage the key of the drill pipe. These contact points may be replaceable in a manner which allows new contact points to be attached to the breakout device when the original contact points become worn from use. These replaceable contact points may be attached by welding, bolting or screwing the contact points to the breakout device. Any other suitable method for attaching the contact points to the breakout device may be used. These contact points may be made of metal, such as steel, aluminum or aluminum alloys, a composite material, or any other suitable material.

An embodiment of the breakout device may also include additional structures such as a flange on the breakout device. One possible function of such a flange is to provide an abutment surface for an operator to grasp or place his or her hand against to aid in manually raising the breakout device to the disengaged position.

In accordance with an alternative embodiment, the breakout device has a key capable of mating with a channel located in a quill. The quill has a socket adjacent to the channel that is capable of receiving a key. All other modifications described above for any embodiment may also be applied to this or other alternative embodiments.

DETAILED DESCRIPTION

Figure 1:
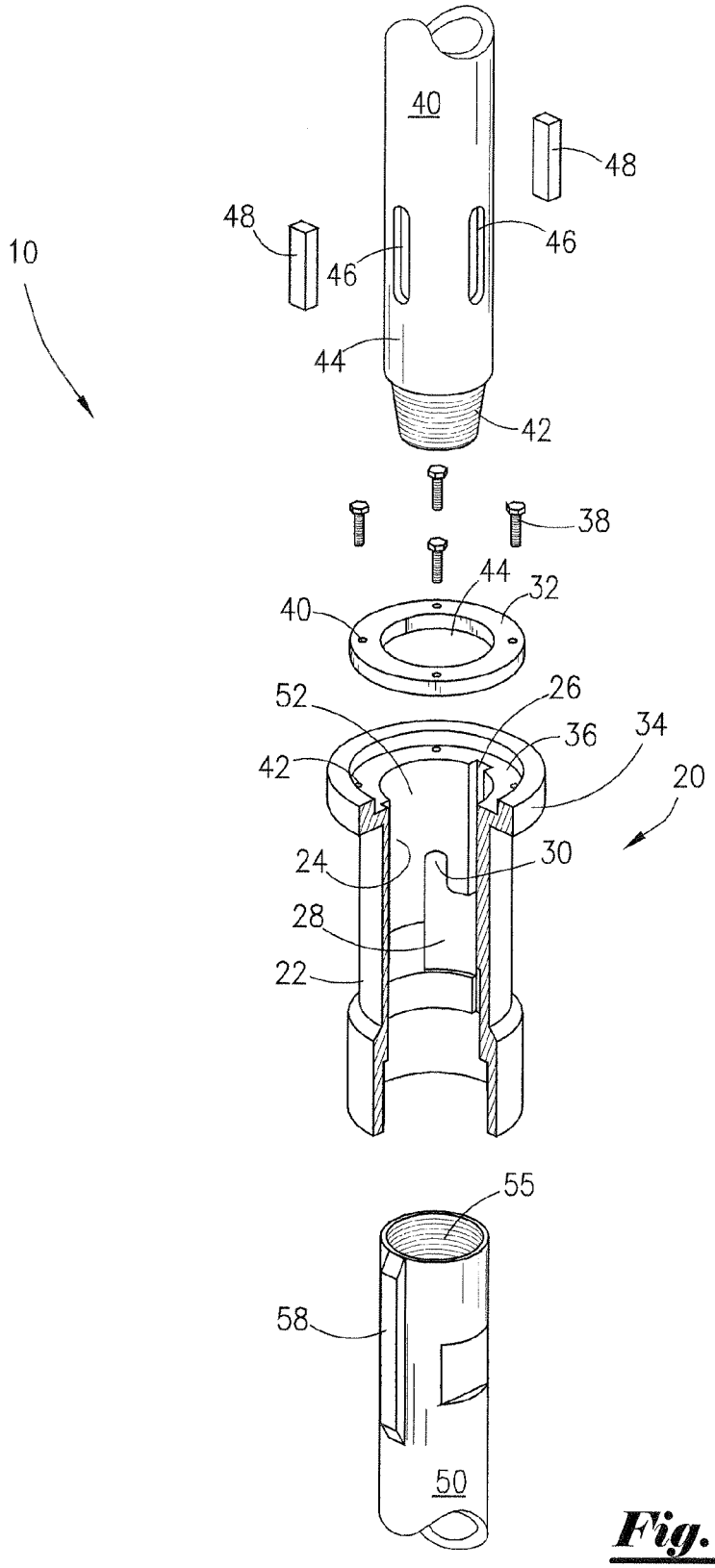
FIG. 1 is an exploded perspective view of a first embodiment depicting a quill, breakout collar, and drill pipe. The breakout collar is shown in partial cutaway.

Referring now to the drawings, there is shown a breakout assembly (10) with a breakout collar (20) having a support structure for maintaining the breakout device in a position, particularly a disengaged position. Referring more particularly to FIG. 1, there is shown an exploded perspective view of a breakout collar (20), a lower section of a quill (40), and an upper section of a drill pipe (50). The breakout collar (20) has an external face (22) and an internal face (24). The breakout collar has first channels (26) formed into the internal face of the breakout collar. The first channels are of a size and shape which allows the channel to mate with keys (48) located on the quill (40). The first channels (26) extend longitudinally along the internal face (24) of the breakout collar. The first channels may be of any length sufficient to allow for the vertical movement of the keys (48) within the first channels. This first channels will allow the breakout collar to be raised and lowered relative to the quill with the keys traveling within the first channels. In an embodiment, the breakout collar is located around the quill by raising the breakout collar so that the quill passes within the breakout collar opening (52).

Adjacent to the first channels (26) are sockets (28). Adjacent to the sockets are second channels (30) which are of a similar width and run parallel to the first channels. The sockets (28) are of a sufficient size to accept the keys (48). In an embodiment, the second channels (30) terminate prior to exiting the upper end of the breakout collar. The second channels terminate in that the keys (48) are prevented from exiting the upper end of the breakout collar directly from the second channels. This can be seen in FIG. 1 and FIG. 7.

Quill (40) has slots (46) for the placement of keys (48). The keys are placed into to the slots and held in place by the breakout collar. The keys may be replaced, as may become necessary as a result of ware or other causes, by separating the breakout collar from the quill to free the keys. The quill has a male threaded end (42) which is suited to mate with the female threaded end (55) of the drill pipe (50).

In an embodiment, the first channel (26) is unobstructed from the upper end of the breakout collar to the lower end of the breakout collar. This can be seen in FIG. 1 and FIG. 7. The first channel is unobstructed in that a key may move into the first channel at the upper end of the breakout collar, and travel the length of the breakout collar without encountering an obstruction sufficient to prevent the key from exiting the lower end of the breakout collar.

A ring (32) is suited to attach to the top of the breakout collar (20). The ring fits within a flange (34) of the breakout collar and rests on a ring contact surface (36) of the breakout collar. The ring is attached to the breakout collar by screws (38) which pass through ring screw holes (40) to mate with ring contact surface threaded holes (42) located in the ring contact surface.

In an embodiment, the breakout collar (20) is located around the quill (40) by first raising the ring (32) so that the quill passes through the ring opening (44). The ring is raised until the ring is above the slots (46). Keys (48) are then placed in slots on opposite sides of the quill. The breakout collar is then raised so that the quill passes through the breakout collar opening (52). The breakout collar is raised until the keys (48) slide within the first channels (26) of the breakout collar. The ring is then attached to the top or upper end of the breakout collar by screws (38). In this manner, the keys are prevented from exiting the top of the first channels as the ring obstructs the first channels at the top of the breakout collar.

For moving the breakout collar to a disengaged position, the breakout collar is raised in a first direction along the quill so that the key (48) is aligned with the socket (28). For moving the breakout collar into a secured position, the breakout collar is then rotated so that the key slides into the socket, and lowered in a second direction so that the key is contained within the second channel (30). In this manner the key supports the breakout collar in a disengaged and secured position. In an embodiment, the second direction is opposite or substantially opposite to the first direction. The second direction is substantially opposite to the first direction if a component vector of the first direction is opposite of a component vector of the second direction. In the disengaged and secured position, the breakout collar is prevented from moving to an engaged position unless the above method is reversed.

Figure 2:
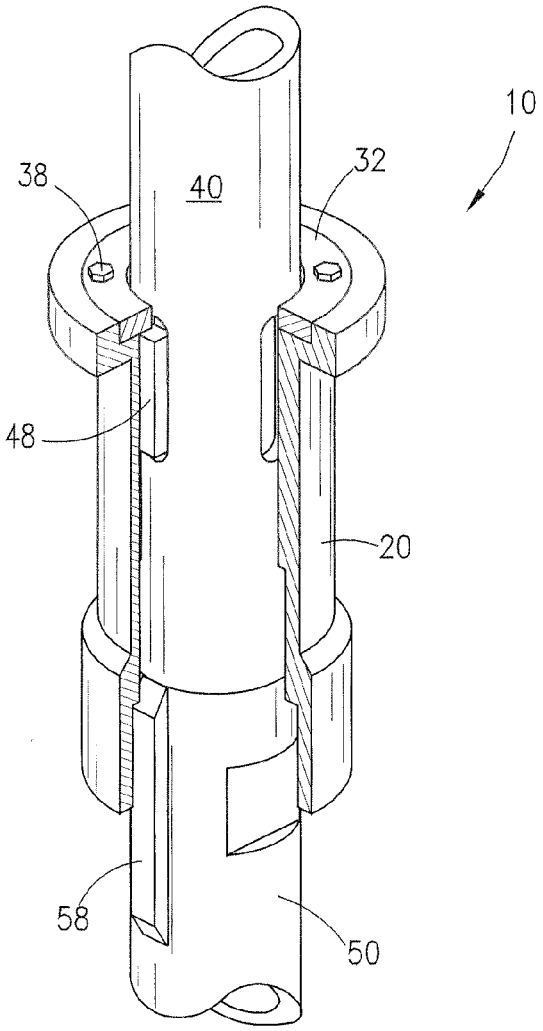
FIG. 2 is a perspective view of a first embodiment depicting a quill connected to a section of drill pipe, and a breakout collar in the engaged position. The breakout collar is shown in partial cutaway.

FIG. 2 depicts the breakout collar (20) in the engaged position. The quill (40) is threadedly attached to a section of drill pipe (50). In the engaged position, the keys (48) are contained entirely within the upper portion of the first channels (26). The upper section of the drill pipe is contained within the lower section of the breakout collar. In the engaged position, the keys prevent the breakout collar from rotating around the quill. The Ring (32) is shown attached to the top of the breakout collar. The ring prevents the keys from exiting the top of the first channels.

Figure 3:
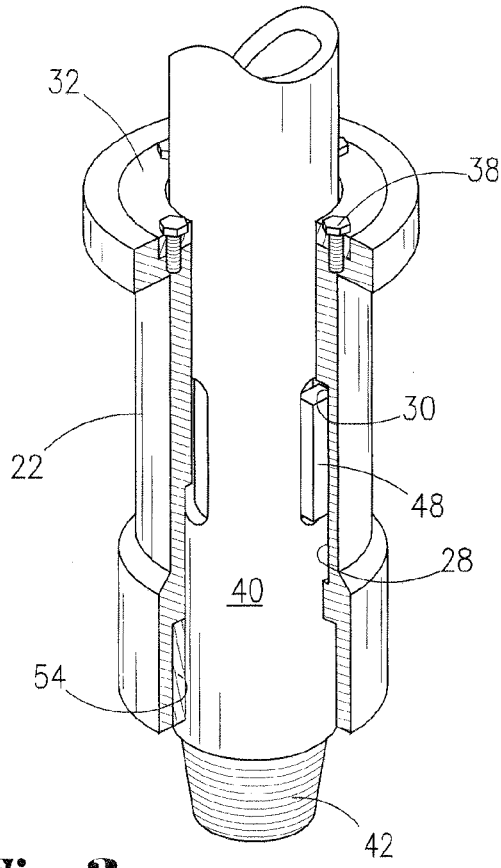
FIG. 3 is a perspective view of a first embodiment depicting a quill and a breakout collar in the disengaged position. The breakout collar is shown in partial cutaway.

FIG. 3 depicts the breakout collar in the disengaged and secured position. Key (48) is contained within the second channel (30).

Figure 4:
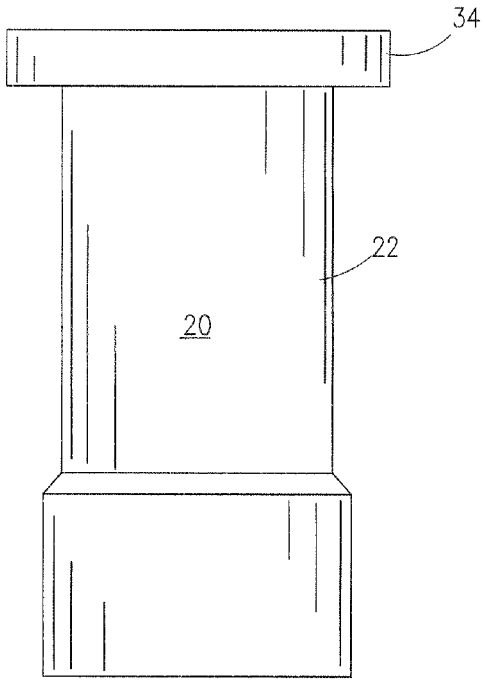
FIG. 4 is an elevation view of a first embodiment depicting a breakout collar.

FIG. 4 is an elevation view of the breakout collar having a flange (34). The flange aids in moving the breakout collar from an engaged to a disengaged position by providing an abutment surface for an operator to rest his or her hand against.

Figure 5:
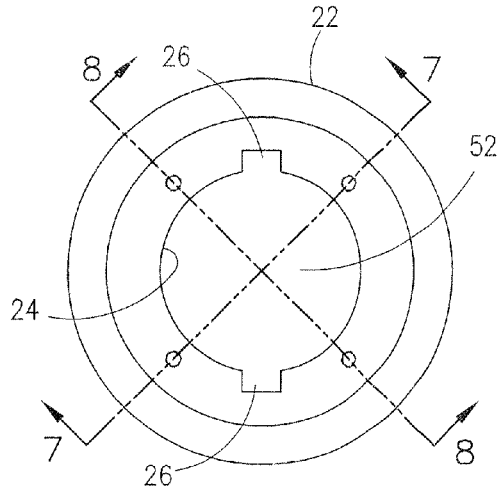
FIG. 5 is a plan view of a first embodiment depicting a breakout collar.

FIG. 5 is a plan view of the breakout collar without the ring (32). In this view, with the ring removed, the first channels (26) are exposed.

Figure 6:
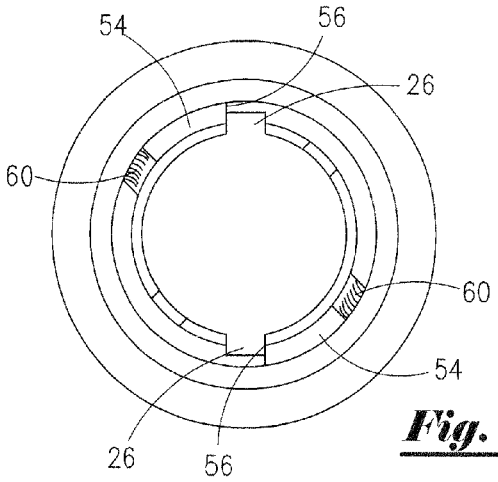
FIG. 6 is a bottom view of a first embodiment depicting a breakout collar.

FIG. 6 is a bottom view of the breakout collar showing the first channels (26) on opposite sides of the internal face (24) of the breakout collar. The breakout collar has contact points (54) on opposite sides of the internal face of the breakout collar. The contact points each have a pipe contact surface (56) that contacts the key stock (58) of the drill pipe (50) when the breakout collar is in the engaged position. In this manner, the drill pipe is prevented from rotating in relation to the quill (40), and the threaded connection between the drill pipe and the quill is prevented from separating, when the quill is rotated in the reverse or unthreading direction.

Figure 7:
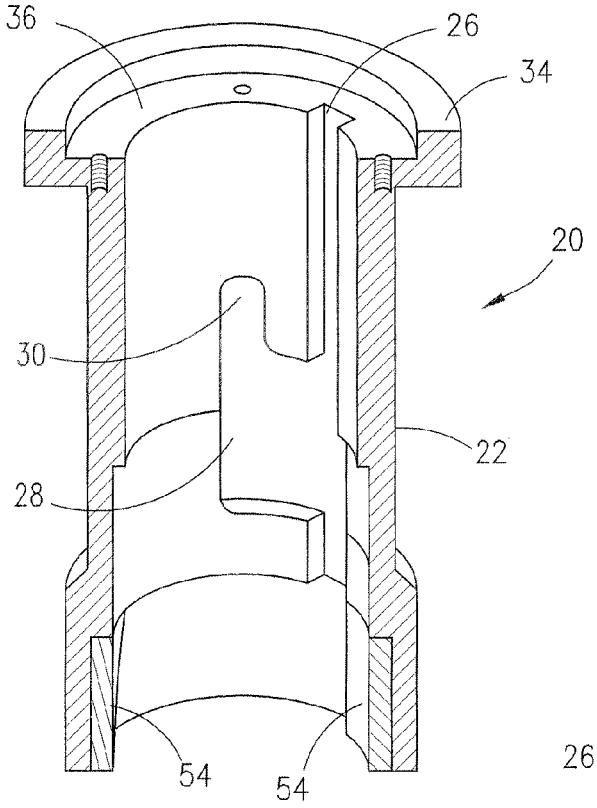
FIG. 7 is a sectional view taken along the line 7-7 in FIG. 5.

FIG. 7 is a sectional view taken along line 7-7 of FIG. 5. Adjacent to the first channel (26) is a socket (28). Adjacent to the socket is a second channel (30). The contact points (54) extend only partially around the circumference of the internal face (24) of the breakout collar, thus allowing for the breakout collar to be lowered over the drill pipe (50) with the key stock (58) of the drill pipe in any position other than directly below the contact point.

The breakout collar (20) is moved from a disengaged position to an engaged position by raising the breakout collar so that the keys (48) of the quill (40) move from the second channel (30) to the socket (28). The breakout collar is then rotated so that the keys move from the socket to the first channel (26) then lowered so that the keys slide to the top of the first channel, and the bottom of the breakout collar slides over the top of the drill pipe (50), which in operation has been threadedly connected to the quill. The quill and breakout collar assembly is then rotated until the contact surface (56) of the contact points (54) comes into contact with the key stock (58) of the drill pipe (50). In this manner the quill, breakout collar and drill pipe are all locked in position so that no one part may rotate in relation to another part. In operation, the quill is then rotated in the reverse or unthreading direction as the end of the next lower section of drill pipe is held in position by a slip and slip bowl assembly, wrench, tong wrench or any other method of locking or securing the drill pipe in place. In this manner the threaded connection between the upper section of drill pipe and the next lower section of drill pipe may be broken.

Figure 8:
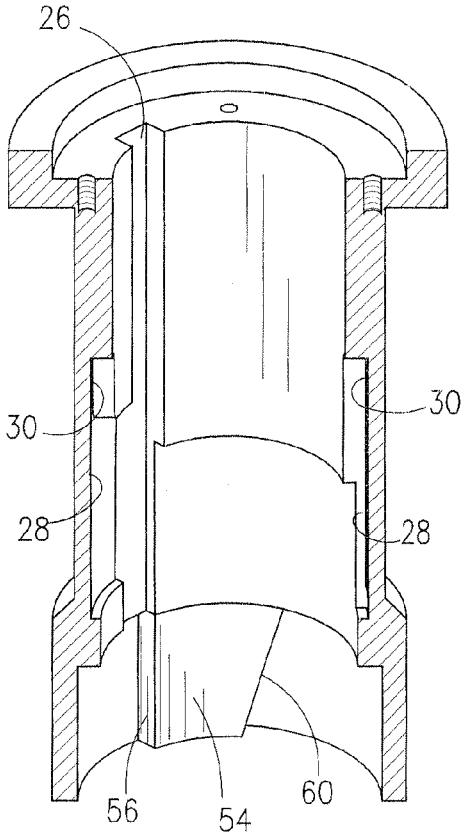
FIG. 8 is a sectional view taken along the line 8-8 in FIG. 5.

FIG. 8 is a sectional view taken along line 8-8 of FIG. 5 depicting the internal face (24) of the breakout collar. Sockets (28) and second channels (30) are shown on opposite sides of the internal face of the breakout collar. The contact point (54) has a sloped edge (60) that allows the breakout collar (20) to be lowered over the drill pipe (50) in a wider variety of rotational positions.

Figure 9:
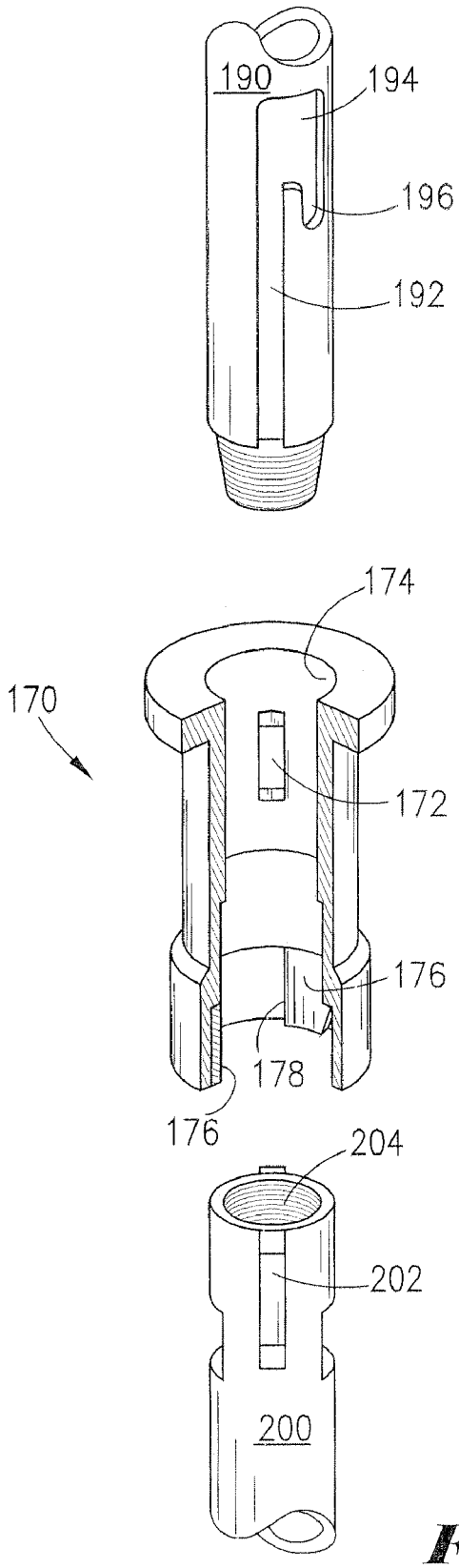
FIG. 9 is an exploded perspective view of an alternative embodiment depicting a quill, breakout collar, and drill pipe. The breakout collar is shown in partial cutaway.

FIG. 9 depicts an alternative embodiment in which a breakout collar (170) has a key (172) on the internal face (174) of the breakout collar. The breakout collar has a contact point (176) with a contact surface (178). The alternative quill has a first channel (192), socket (194), and second channel (196) that are located in the quill (190). The drill pipe (200) comprises a key stock (202) and a female threaded end (204).

Figure 10:
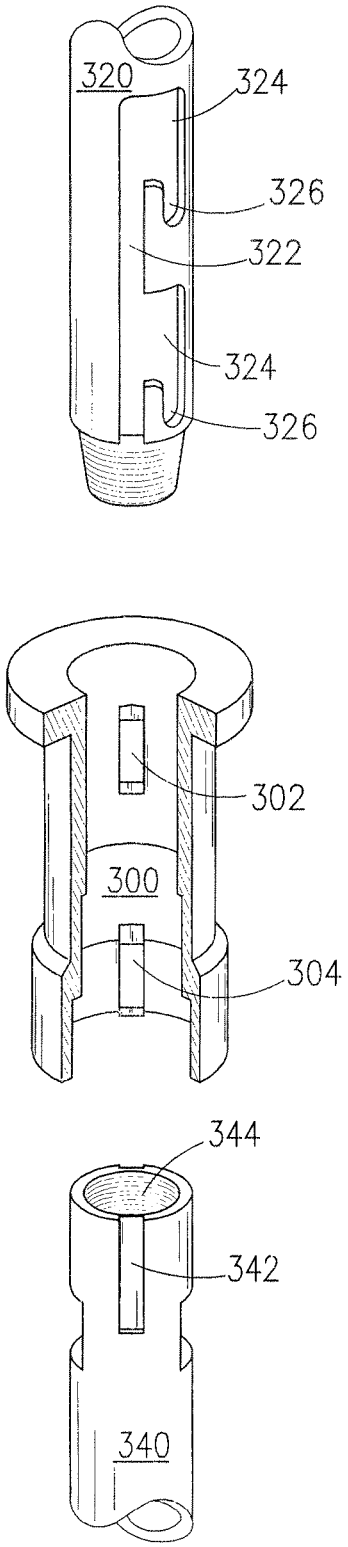
FIG. 10 is an exploded perspective view of a second alternative embodiment depicting a quill, breakout collar, and drill pipe. The breakout collar is shown in partial cutaway.

FIG. 10 depicts a second alternative embodiment in which a breakout collar (300) has a first key (302) and a second key (304). The quill (320) has a first channel (322) which is of a width sufficient to allow the first key and the second key to slide in the first channel. The breakout collar is moved to a disengaged position by raising the breakout collar so that the first key and the second key are aligned with sockets (324). The breakout collar is then rotated so that the first key and the second key slide into the sockets. The breakout collar is then lowered so that the first key and the second key slide into the second channels (326).

The alternative embodiment shown in FIG. 10 also has a drill pipe (340) with drill pipe channels (342). The drill pipe (340) also has a female threaded end (344).

The breakout collar (300) is moved from a disengaged position to an engaged position by raising the breakout collar so that the first key (302) and the second key (304) of the breakout collar (300) move from the second channels (326) to the sockets (324). The breakout collar is then rotated so that the keys move from the sockets to the first channel (322) then lowered so that the second key (304) slides into the drill pipe channel (342) of the drill pipe (340), which in operation has been threadedly connected to the quill (320). In this manner the quill, breakout collar and drill pipe are all locked in position so that no one part may rotate in relation to another part.

It is thought that the method and device for supporting the breakout device in a position as described herein and many of its intended advantages will be understood from the foregoing description. It is also thought that various changes in form, construction, and arrangement of the parts of the method and device may be made without departing from the spirit and scope of the embodiments described herein. The form herein described is intended to be merely an illustrative embodiment of the method and device. The claims should not be construed as limited to the specific forms shown and described, but instead is as set forth in the following claims.

We claim:

1. A device for locking a tubular in a drill string for rotation with a quill of a drilling unit comprising:

a. a collar having at least one longitudinal first channel for receiving a key within an internal face of said collar, said collar having an upper end and a lower end;

b. said collar having at least one socket for receiving the key within an internal face of said collar, said socket being adjacent to said first channel;

c. said collar having at least one second channel for receiving the key within an internal face of said collar, said second channel being adjacent to said socket and parallel to said first channel;

d. said collar having at least one contact point connected to said lower end of said internal face, said contact point contacting a key stock of said tubular;

e. said first channel extending above and below said socket and being unobstructed from said upper end of said collar to said lower end of said collar.

2. The device as in claim 1 wherein said second channel terminates prior to exiting said upper end of said collar.

3. The device as in claim 2 further comprising a ring releasably connected said upper end of said collar, whereby said ring obstructs said first channel at said upper end of said collar.

4. The device as in claim 3 further comprising a flange for receiving said ring, said flange being connected to said upper end of said collar.

5. The device as in claim 4 further comprising:

a. at least one tubular;

b. a drilling unit;

c. a quill connected to said drilling unit, said quill being threadedly connected to said tubular, said quill having at least one key connected to said quill; and d. said collar being coaxially located around said quill, whereby said key of said quill is moveable from said first channel, to said socket, and to said second channel.

6. The device in claim 1 further comprising:

a. at least one tubular;

b. a drilling unit;

c. a quill connected to said drilling unit, said quill being threadedly connected to said tubular, said quill having at least one key connected to said quill; and said collar being coaxially located around said quill, whereby said key of said quill is moveable from said first channel, to said socket, and to said second channel.

* * * * *